US012767429B2

(12) United States Patent
Bö et al.

(10) Patent No.: US 12,767,429 B2
(45) Date of Patent: Oct. 20, 2026

(54) GAS INLET ASSEMBLY FOR OIL TANKS

(71) Applicant: GBA Marine AS, Kolbjörnsvik (NO)

(72) Inventors: Rune Bö, Arendal (NO); Helge K. Aasen, Kolbjörnsvik (NO)

(73) Assignee: GBA Marine AS, Kolbjörnsvik (NO)

( * ) Notice: Subject to any disclaimer, the term of this patent is extended or adjusted under 35 U.S.C. 154(b) by 165 days.

(21) Appl. No.: 18/567,948

(22) PCT Filed: Jun. 17, 2022

(86) PCT No.: PCT/NO2022/050137
§ 371 (c)(1),
(2) Date: Dec. 7, 2023

(87) PCT Pub. No.: WO2022/265518
PCT Pub. Date: Dec. 22, 2022

(65) Prior Publication Data

US 2024/0262616 A1 Aug. 8, 2024

(30) Foreign Application Priority Data

Jun. 18, 2021 (NO) ..... 20210796

(51) Int. Cl.
*B65D 90/44* (2006.01)

(52) U.S. Cl.
CPC ..... *B65D 90/44* (2013.01)

(58) Field of Classification Search
CPC ..... B65D 90/34; B65D 90/28; B65D 90/44; B65D 88/54; B65D 83/303; B65D 88/30; B01F 23/454; B01F 23/23; B01F 23/2323; B01F 33/81; B05B 3/1007
USPC ..... 239/214
See application file for complete search history.

(56) References Cited

U.S. PATENT DOCUMENTS 1,994,239 A * 3/1935 Beekhuis ..... B05B 3/1007 425/8
3,694,168 A * 9/1972 Hitzemann ..... C01G 23/07 431/168
3,710,549 A 1/1973 Nichols et al.
8,641,017 B2 2/2014 Aasen et al.
(Continued)

FOREIGN PATENT DOCUMENTS

DE 1269053 B 5/1968
FR 2266837 * 4/1974 ..... F16K 31/126
GB 2217767 * 4/1989 ..... E04H 7/02
(Continued)

OTHER PUBLICATIONS

International Search Report and Written Opinion mailed Oct. 5, 2022 for International Patent Application No. PCT/NO2022/050137.
(Continued)

*Primary Examiner* — Christopher R Dandridge
(74) *Attorney, Agent, or Firm* — Alix, Yale & Ristas, LLP

(57) ABSTRACT

A gas inlet assembly for oil tanks, connectable to a gas inlet pipe, for the maintenance of pressure and a non-explosive atmosphere during unloading of oil from an oil tank has at least one inlet conduit arranged to direct a unidirectional flow of gas from the inlet pipe to a primary inlet nozzle. The primary inlet nozzle includes a spreader element configured to spread the inflowing inert gas within the tank with a horizontal velocity component larger than the vertical velocity component.

13 Claims, 2 Drawing Sheets

(56) References Cited

U.S. PATENT DOCUMENTS

| | | | |
|---|---|---|---|
| 2008/0011219 | A1 | 1/2008 | Bronneberg et al. |
| 2016/0165708 | A1 | 6/2016 | Nishisaka et al. |

FOREIGN PATENT DOCUMENTS

| | | | | |
|---|---|---|---|---|
| JP | 2020091020 | A | 6/2020 | |
| JP | 2020176644 | A | 10/2020 | |
| RU | 2101055 | C1 * | 1/1998 | ..... A62C 3/06 |

OTHER PUBLICATIONS

International Preliminary Report on Patentability dated Aug. 17, 2023 for International Patent Application No. PCT/NO2022/050137.

Notification of Reasons for Rejection dated Jun. 2, 2026 for Japanese Patent Application No. 2023-577643.

* cited by examiner

GAS INLET ASSEMBLY FOR OIL TANKS

BACKGROUND

The disclosed embodiments relate to a method and/or system that allows addition of inert gas to the tanks of oil tankers during unloading in a manner that reduces the tendency of increased vaporization due to mechanically induced convection and turbulent mixing of tank atmosphere during unloading.

A challenge in handling of volatile fluids in large tanks, such as in oil tankers, is the vaporization of significant amounts of oil. On one hand, such vaporization is a loss of product and thereby an economic loss. Another aspect is that it causes pollution and a strain on the environment. Last, but not least, such evaporation is a safety risk and may cause fire or explosions.

Systems therefore have been designed to minimize or reverse such evaporation. One such system is described in WO 2007/086751, wherein vapour evaporated from oil is reintroduced into the oil. This and other systems are mainly designed for situations during transportation in which the tanks are closed and in a "steady state" condition, or for handling gas emissions during cargo loading operations.

A particular challenge occurs in situations in which the oil is unloaded from the tanks and the atmosphere over the continuously decreasing oil level is replaced by an inert gas introduced to maintain a certain pressure and to prevent explosion risks. The inventive embodiments disclosed herein minimize such problems during unloading of oil.

SUMMARY

By "moderately conical" as used herein is understood a conical shape with an inclination of less than 25 degrees, more preferably less than 15 degrees and most preferred less than 5 degrees.

By "inversely conical" as used herein is understood a conical shape where the centre point is lower than the periphery.

By "negative vertical velocity component" as used herein is understood a vertical velocity component in upwards direction.

A specific aim of the disclosed embodiments is to increase the inlet area of the tank inlet opening since this leads to reduced velocity, reduced turbulence and thereby reduced vaporization. A simple extension of the inlet conduit would also lead to reduced velocity, but would still be subject to disturbances and turbulence in the incoming flow, and would be far from ideal in handling the overall challenge of reducing vaporization.

The disclosure offers a far better solution by directing the flow from the extended inlet conduit vertically down to a spreader disc that causes a 360 degrees spread of the inlet flow and ensuring that the dominant velocity component is horizontal from the spreader disc into the tank.

The spreader disc may be flat or moderately conical with a conical angle of a few degrees. It may also be "inversely" conical, i.e., with the centre of the spreader disc as its lowermost point. This latter embodiment is actually a preferred embodiment, causing the flow outwards from the spreader disc to be mainly horizontal with a small vertical velocity component that is actually upwards at the circumference of the spreader disc.

In yet another preferred embodiment the spreader disc is provided with a number of small holes to allow a small "leakage" flow to pass through the disc in a downwards direction. The holes are mainly to ensure that liquid is not collected on the disc, and the holes are sufficiently small so as not to significantly influence the general concept of largely horizontal gas flow into the tank, but will also contribute to increase the overall inlet area.

BRIEF DESCRIPTION OF THE DRAWINGS

Below, the invention is described in further detail in the form of non-limiting embodiments illustrated by drawings, where.

DETAILED DESCRIPTION

Figure 1:
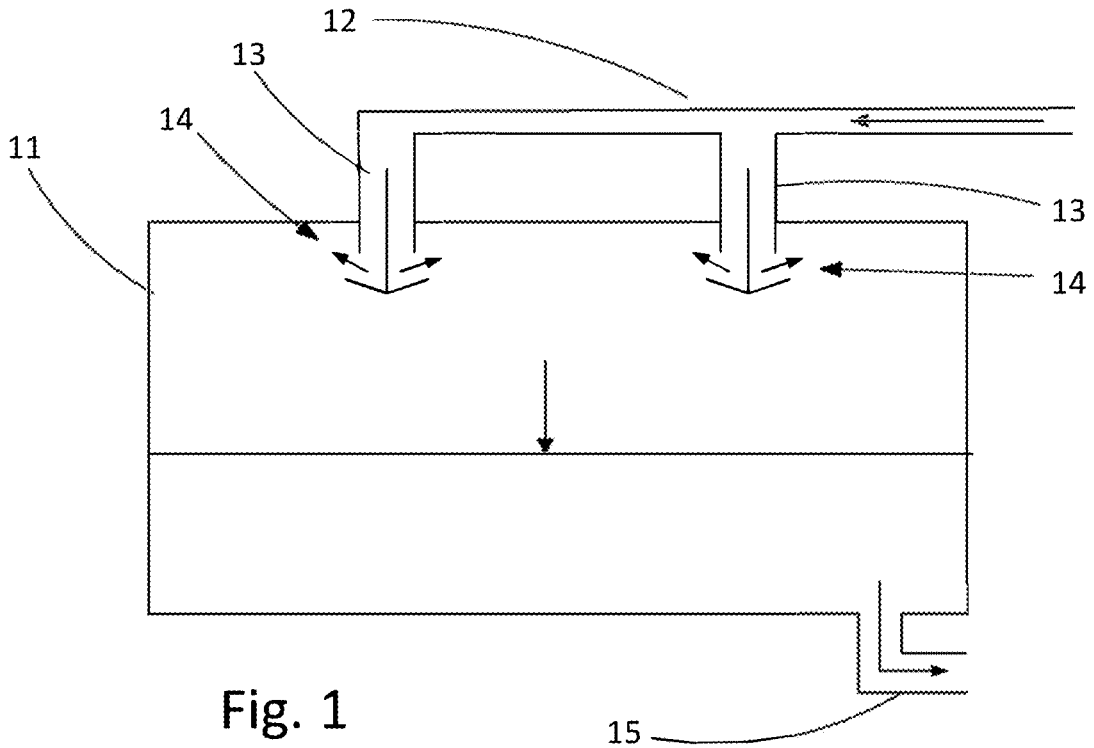
FIG. 1 is a schematic side sectional view of a tank in which an embodiment of the present invention is included.

FIG. 1 is a schematic simplified cross-sectional side view of a tank 11 provided with an inert gas interface. A supply pipe 12 for gas leads to the tank 11 and is typically branched to a number of two or more vertical inlet conduits 13, each of which being provided with a primary inlet nozzle 14 of particular design. The inlet nozzles shown in FIG. 1 are both primary inlet nozzles, their design and properties being discussed in further detail below. Typically, the inlet conduit (13) is vertically arranged between the supply pipe (12) and the inlet nozzle (14). Presence of secondary inlet nozzle(s) is optional. FIG. 1 furthermore shows a discharge pipe 15 for volatile liquid, typically oil.

When oil is drained from the tank through discharge pipe 15, inert gas is introduced into the tank through the supply pipe 12, the inlet conduits 13 and the inlet nozzles 14 to avoid underpressure in the tank. It is convenient to establish a certain overpressure in the tank in order to avoid excessive evaporation from the oil surface during drainage. At the same time It is also important to avoid mechanically induced convection between the oil and tank atmosphere, or turbulent mixing over the oil surface, which would both lead to increased evaporation. One element contributing to avoiding turbulence in the tank is the cross-sectional dimension of the inlet conduit 13, which is quite large and typically larger than the cross-section of the supply pipe 12, to thereby allow a slow movement of the inlet gas for all relevant gas rates.

Figure 2A:
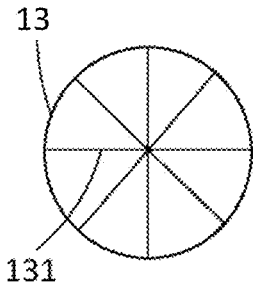
FIGS. 2A-2C are top sectional views of three variants of the vertical inlet conduit.
Figure 2B:
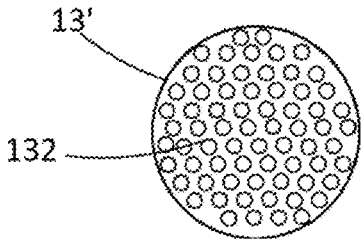
Figure 2C:
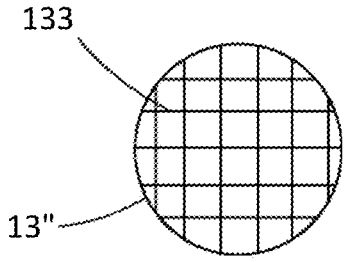

FIGS. 2A-2C are top sectional views of three variants of inlet conduit 13. In the embodiment shown by FIG. 2A, the inlet conduit is divided by partition walls 131 into eight parallel inlet sections, thereby ensuring that the flow of inlet gas is not only slow but also parallel, which means that there is little or no turbulence in the flow. The entire flow of gas reaching the inlet nozzles 14 is thus parallel and laminar and comparatively slow mowing.

FIG. 2B shows a different configuration of the inlet conduit 13', consisting of a plurality of parallel bores 132 through an otherwise compact tube element. The high number of bores ensures an extreme directional control of the entering gas. The disadvantage compared to the embodiment of FIG. 2A, is that a larger portion of the cross-section is occupied by solid material and that less volume is available for the gas flow.

In the embodiment shown by FIG. 2C, the inlet conduit 13" is divided by partition walls 133 in a grid pattern. This will provide better directional control than FIG. 2A and occupy less of the cross-section by solid material than the embodiment of FIG. 2B, thus making more volume available for gas flow.

As a whole, all variants shown in FIGS. 2A-2C allow a high directional control of the inlet gas, i.e., a laminar flow of gas reaching the inlet nozzles 14.

Figure 3A:
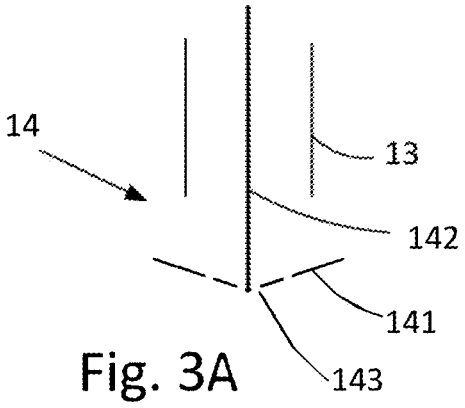
FIGS. 3A-3D are schematic side sectional views of variants of an inlet gas supply nozzle.

Now we are directing the focus to FIGS. 3A-3D showing four embodiments of the primary inlet nozzle 14 in greater detail. The primary inlet nozzle of FIG. 3A is connected to the lower end of the inlet conduit 13 and comprises a spreader element or spreader disc 141 having an inversely conical shape, i.e., a conical shape with the centre point being the lowermost point of the disc. The inversely conical spreader disc 141 is attached to a rod 142 extending through at least part of the inlet conduit 13. The inversely conical shape of the disc 141 causes the inert gas entering through pipe stub 141 to be forced radially outwards and slightly upwards when leaving the periphery of the disc, i.e., with a vertical velocity component defined as negative herein. The spreader disc 141 of FIG. 3A furthermore shows a number of small holes 143 preventing liquid from being accumulated on the spreader disc. In FIGS. 3A-3D the kind of internal arrangement in the inlet conduit 13 for ensuring an entirely parallel flow, which is illustrated in FIGS. 2A-2C, is omitted.

Figure 3B:
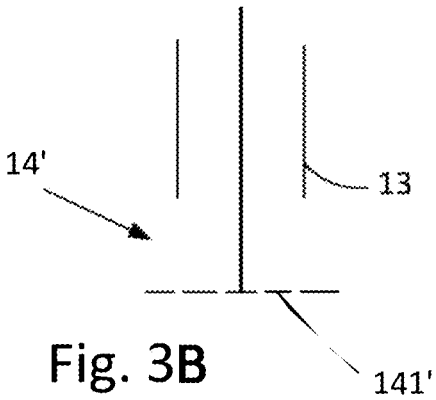

FIG. 3B also shows a primary inlet nozzle 14'. The only difference of FIG. 3B to as compared to FIG. 3A is the design of the spreader disc 141' which extends flat and horizontally from its attachment point. This design causes gas entering through inlet conduit 13 to be forced outwards and mainly horizontally, i.e., with no vertical velocity component at the periphery of the spreader disc.

Figure 3C:
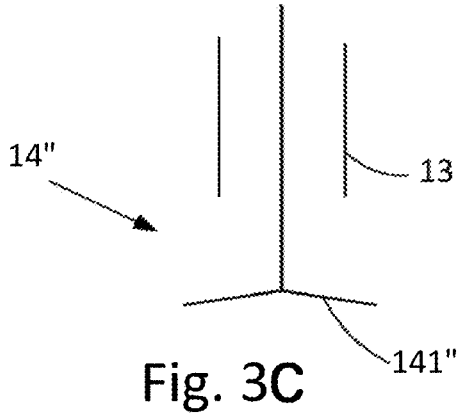

Now turning to FIG. 3C showing a primary inlet nozzle 14". The only difference of FIG. 3C to as compared to FIGS. 3A and 3B is the design of the spreader disc 141" which has a moderately conical shape with its centre point being the top point of the spreader disc. This design causes gas entering through inlet conduit 13 to be forced outwards and slightly downwards, i.e., with a limited vertical velocity component at the periphery of the spreader disc.

Figure 3D:
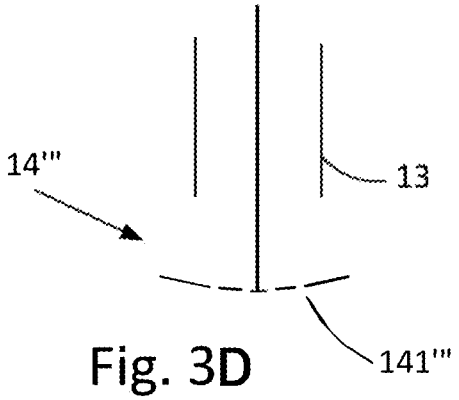

Now turning to FIG. 3D showing a primary inlet nozzle 14". The only difference of FIG. 3D to as compared to FIGS. 3A-3C is the design of the spreader disc 141" which has a curved shape with the concave side facing upwards, its centre point being the lowermost point of the spreader disc. This design causes gas entering through inlet conduit 13 to be forced outwards and slightly upwards, i.e., with a slightly negative vertical velocity component at the periphery of the spreader disc, rather similar to the one of FIG. 3A.

Common for all embodiments 3*a*-3*d* is the fact that the horizontal velocity component, for the gas flow leaving the primary inlet nozzle 14, is larger than the vertical velocity component also when regarding absolute values. Additionally, the overall linear velocity is comparatively small due to the fact that the inflowing inert gas is spread over a full circle, i.e., 360 degrees around the spreader discs.

Flat, and in particular inversely conical and curved, spreader discs should preferably be provided with small drainage holes like the holes 143 in FIG. 3A, to prevent liquid from accumulating thereon. These holes should be sufficiently small to not change the general properties of the nozzle (or interface); i.e., the amount of inert gas flowing through such holes should be a lot less than the flow of inert gas over the periphery of the spreader disc. Typically, the flow thorough the holes 143 or the like should constitute less than 10 vol-% of the flow of inert gas and more preferably less than 5 vol-%.

The arrangement described above and shown in FIGS. 1 to 3A-3D ensures a minimum of turbulence around the inlet openings and no turbulence at the surface of the oil, thereby obtaining the desired objective to reduce vaporization to a minimum during unloading of oil.

Figure 4:
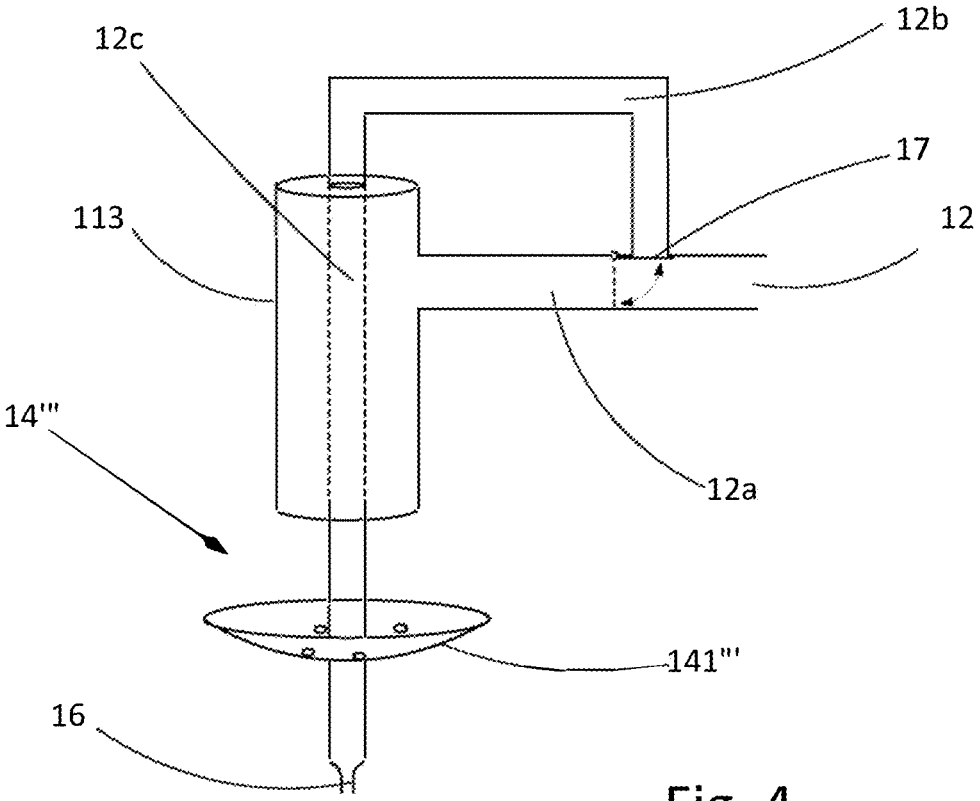
FIG. 4 is a schematic side sectional view of another embodiment of the present invention the earlier embodiments.

FIG. 4 shows an embodiment of the inert gas interface that is different from the ones previously shown, mainly in that it exhibits a primary nozzle comprising a spreader disc 141" like the one of FIG. 3D, arranged below an inlet conduit 113 as well as a secondary inlet nozzle 16. The supply pipe 12 for inert gas is branched to a first pipe stub 12*a* connected to the inlet conduit 113 and to a second pipe stub 12*b* connected to the secondary inlet nozzle. The second pipe stub 12*b* is angled twice in the embodiment shown and exhibits a section 12*c*, which runs coaxially through the inlet conduit 113 and which is also used as a holder for the spreader disc 141" before terminated in the secondary inlet nozzle 16.

A change-over valve member 17 is arranged to hold one of the pipe stubs 12*a* and 12*b* open at the time, i.e., when one pipe stub 12*a* or 12*b* is available for gas supply, the other is not.

When valve member 17 is in its horizontal position as shown in FIG. 4, gas supplied enters the primary nozzle through pipe stub 12*a* and flows through the broader inlet conduit 113 connected to the primary nozzle and is eventually spread by the spreader disc 141" in the same manner as explained in relation to FIGS. 1 and 3A-3D.

On the other hand, when valve member 17 is switched to its vertical position, the supply gas enters pipe stub 12*b* which is connected to the secondary inlet nozzle 16 arranged vertically and without any spreading disc or similar element. The secondary inlet nozzle (16) is designed to supply gas at a comparatively high speed and with a predominant downwards vertical velocity component, the magnitude of which depending upon the pressure applied and the chosen dimensions. Typically, the secondary inlet nozzle (16) is arranged to supply gas with a vertical velocity component exceeding 3 m/s at a level 3 meters below the nozzle.

The secondary inlet nozzle is not intended for use when the tank is unloaded for oil but rather for replacing tank atmosphere in an efficient manner when the tank is already empty and there is no concern for vaporization of volatile fluid. This kind of operation is typically required prior to tank inspection, repair work, etc., and is used to replace the initially explosive tank atmosphere first with an inert gas, and then with breathable air.

As also shown by FIG. 4, an outer face of the secondary inlet nozzle 16 acts as a holder for the spreader disc 242, thereby also fulfilling the task of the rod 142 shown in FIGS. 3A-3D.

Naturally, the change-over valve 17 may be replaced by two separate valves, one in each of the pipe stubs 12*a*, 12*b*. The valve or valves may be controlled automatically or remote as well as manually.

Generally speaking, the primary nozzle according to the present invention is arranged to supply gas at a vertical velocity rate less than 0.2 m/s when measured at a level 3 meters below the nozzle.

The invention claimed is:

1. An oil tank gas inlet assembly connectable to a gas supply pipe for maintenance of pressure and a non-explosive atmosphere during unloading of oil from an oil tank, comprising:

at least one inlet conduit having a cross-sectional dimension that is larger than a cross-sectional dimension of the gas supply pipe;

at least one inlet conduit being arranged to direct a unidirectional flow of gas from the gas supply pipe to a primary inlet nozzle having a spreader element configured to spread the flow of gas within the oil tank, wherein the flow of gas has a horizontal velocity component larger than a vertical velocity component; and a secondary inlet nozzle configured to supply the flow of gas into the oil tank at a vertical velocity, wherein the vertical velocity of the flow of gas supplied by the secondary inlet nozzle is greater than the vertical velocity component of the flow of gas of the primary inlet nozzle, and wherein the secondary inlet nozzle is arranged to supply the flow of gas into the oil tank at a level below the spreader element.

2. The oil tank gas inlet assembly of claim 1, wherein the spreader element is configured to spread the flow of gas in a 360 degree circular or conical flow from the primary inlet nozzle.

3. The oil tank gas inlet assembly of claim 1, wherein the spreader element is disc shaped and is one of flat, conical, convex curved, or concave curved.

4. The oil tank gas inlet assembly of claim 1, wherein the primary inlet nozzle is configured to supply gas at a vertical velocity rate that is less than 0.2 m/s when measured at a level 3 meters below the primary inlet nozzle.

5. The oil tank gas inlet assembly of claim 1, wherein the at least one inlet conduit is arranged vertically between the gas supply pipe and the primary inlet nozzle.

6. The oil tank gas inlet assembly of claim 2, wherein the at least one inlet conduit is arranged vertically between the gas supply pipe and the primary inlet nozzle.

7. The oil tank gas inlet assembly of claim 1, wherein the secondary inlet nozzle is configured to supply gas with a predominantly downward vertical velocity component.

8. The oil tank gas inlet assembly of claim 7, wherein the predominately downward vertical velocity component exceeds 3 m/s at a level 3 meters below the secondary inlet nozzle.

9. The oil tank gas inlet assembly of claim 1, wherein the primary inlet nozzle and the secondary inlet nozzle are both connected to the gas supply pipe.

10. The oil tank gas inlet assembly of claim 1, further comprising a change-over valve configured to open and close gas flow to each of the primary inlet nozzle and the secondary inlet nozzle.

11. The oil tank gas inlet assembly of claim 1, further comprising a pipe stub connected to the secondary inlet nozzle, said pipe stub being arranged coaxially within the primary inlet nozzle.

12. An oil tank gas inlet assembly connectable to a gas supply pipe for maintenance of pressure and a non-explosive atmosphere during unloading of oil from an oil tank, comprising:

at least one inlet conduit having a cross-sectional dimension that is larger than a cross-sectional dimension of the gas supply pipe;

at least one inlet conduit being arranged to direct a gas flow from the gas supply pipe to a primary inlet nozzle having a spreader element configured to spread the flow of gas within the oil tank, wherein the flow of gas has a horizontal velocity component larger than a vertical velocity component; and a secondary inlet nozzle configured to supply the a flow of gas into the oil tank at a vertical velocity, wherein the secondary inlet nozzle is arranged to supply the flow of gas into the oil tank at a level below the primary inlet nozzle, and where the vertical velocity of the flow of gas supplied by the secondary inlet nozzle exceeds 3 m/s at a predetermined position below the secondary inlet nozzle and the vertical velocity component of the flow of gas supplied by the primary inlet nozzle is less than 0.2 m/s.

13. An oil tank gas inlet assembly connectable to a gas supply pipe for maintenance of pressure and a non-explosive atmosphere during unloading of oil from an oil tank, comprising:

at least one inlet conduit having a cross-sectional dimension that is larger than a cross-sectional dimension of the gas supply pipe;

at least one inlet conduit being arranged to direct a gas flow from the gas supply pipe to a primary inlet nozzle having a spreader element configured to spread the gas flow within the oil tank, wherein the flow of gas has a horizontal velocity component larger than a vertical velocity component; and a secondary inlet nozzle configured to supply a flow of gas into the oil tank at a vertical velocity, wherein the secondary inlet nozzle is arranged to supply the flow of gas into the oil tank at a level below the primary inlet nozzle, and where the vertical velocity of the flow of gas supplied by the secondary inlet nozzle is greater than the vertical velocity component of the flow of gas supplied by the primary inlet nozzle and the vertical velocity component of the flow of gas supplied by the primary inlet nozzle is less than 0.2 m/s.

* * * * *